US005443107A

United States Patent [19]

Kraler

[11] Patent Number: 5,443,107

[45] Date of Patent: Aug. 22, 1995

[54] ROLL DOWN SHUTTER

[76] Inventor: Franz Kraler, A-9913 Abfaltersbach 125, Austria

[21] Appl. No.: 87,793

[22] PCT Filed: Oct. 28, 1992

[86] PCT No.: PCT/AT92/00134

§ 371 Date: Dec. 10, 1993

§ 102(e) Date: Dec. 10, 1993

[87] PCT Pub. No.: WO93/10325

PCT Pub. Date: May 27, 1993

[30] Foreign Application Priority Data

Nov. 15, 1991 [AT] Austria ..... 2278/91

[51] Int. Cl.[6] ..... E06B 9/08

[52] U.S. Cl. ..... 160/133; 160/235

[58] Field of Search ..... 160/133, 235, 23.1, 160/271, 291, DIG. 15

[56] References Cited

U.S. PATENT DOCUMENTS

| | | | |
|---|---|---|---|
| 1,081,202 | 12/1913 | Brunst | 160/235 X |
| 2,204,363 | 6/1940 | Jenkins et al. | 160/235 X |
| 2,545,400 | 3/1951 | White | 160/235 X |
| 2,563,549 | 8/1951 | Poggi | 160/235 |
| 2,894,572 | 7/1959 | Nelson | 160/133 |
| 4,217,945 | 8/1980 | Stark | 160/133 X |

FOREIGN PATENT DOCUMENTS

| | | | |
|---|---|---|---|
| 1266581 | 6/1961 | France . | |
| 82738 | 12/1962 | France | 160/133 |
| 2458944 | 6/1976 | Germany . | |
| 2644142 | 4/1978 | Germany | 160/133 |
| 2740869 | 3/1979 | Germany | 160/133 |
| 5033 | of 1878 | United Kingdom | 160/133 |

*Primary Examiner*—Blair M. Johnson
*Attorney, Agent, or Firm*—Lorusso & Loud

[57] ABSTRACT

Roll-down shutter with a rotating, self-locking winding shaft with coilable shutter armor made of linked interconnected shutter elements, whereby the top-most shutter element is attached to the winding shaft. In order to make an unauthorized separation of the shutters from the winding shaft practically impossible, the top-most shutter element is bound closed-shape with the winding shaft.

5 Claims, 3 Drawing Sheets

Figure 1:
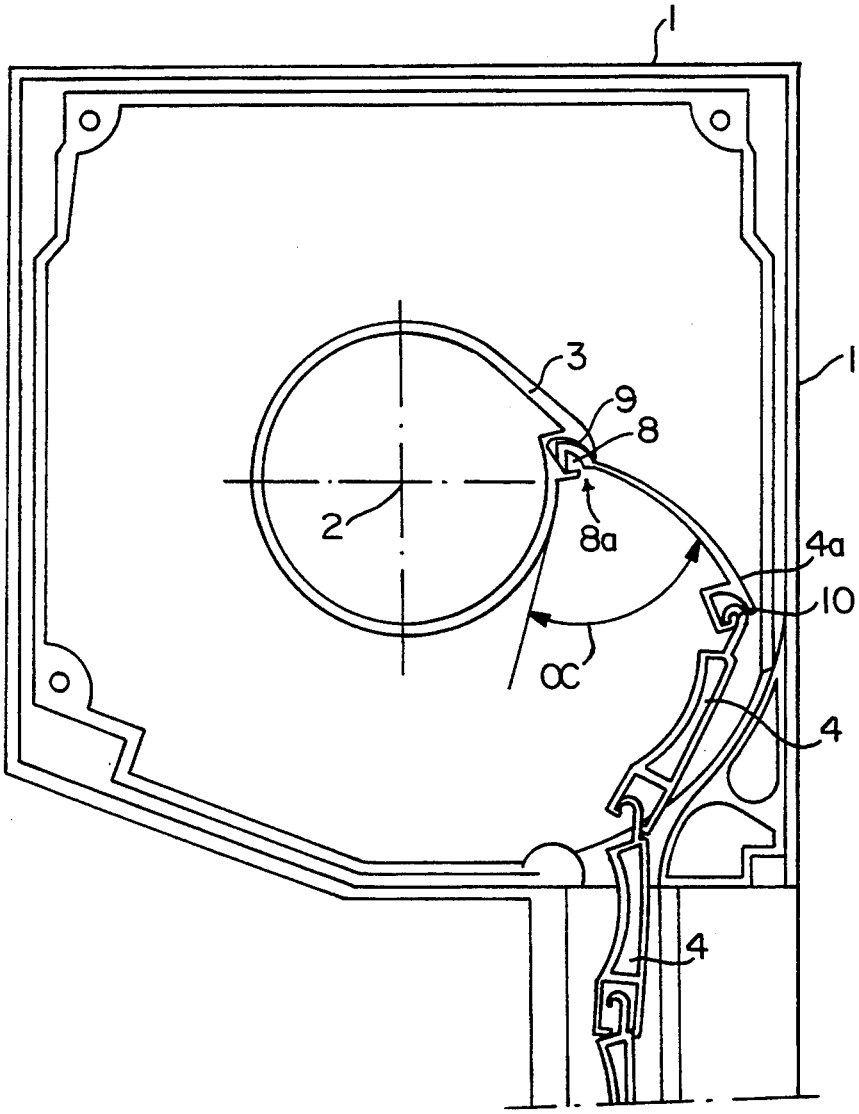
Figure 1:
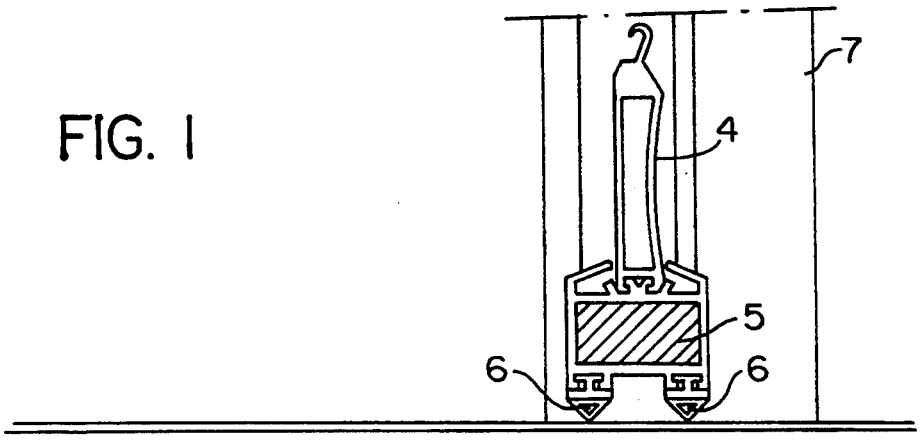

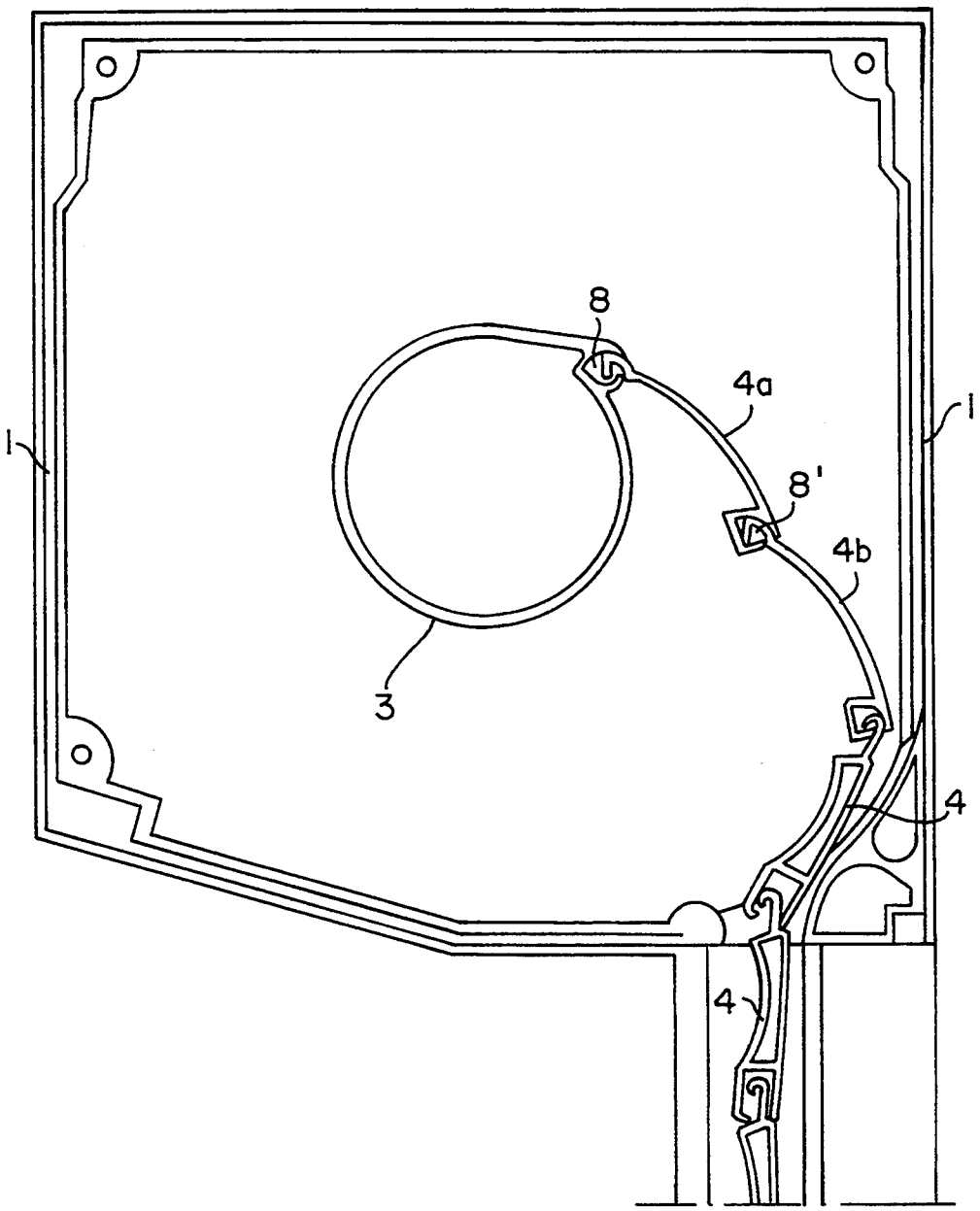
FIG. 2
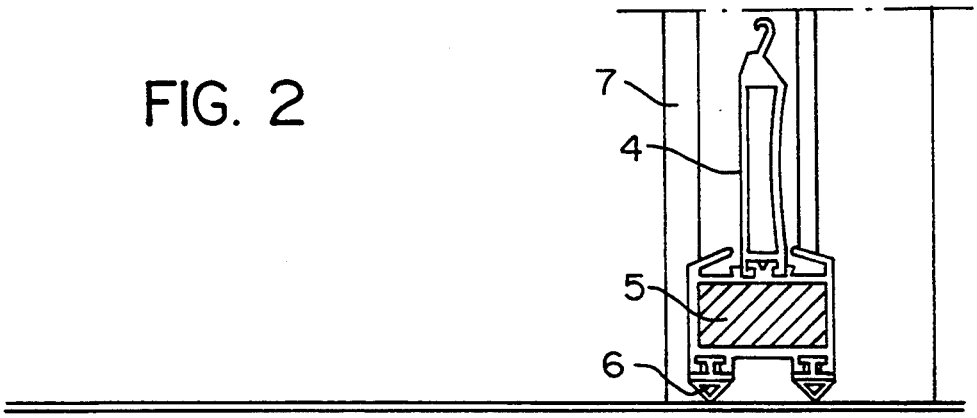

ROLL DOWN SHUTTER

BACKGROUND OF THE INVENTION

The invention relates to a roll-down shutter comprising a rotating, self-locking winding shaft having coilable shutter-armor made of linked interconnected shutter elements, whereby the top-most shutter element is attached to the winding shaft.

Various methods are already known for increasing the security of roll-down shutters. One such method consists of a self-locking winding shaft that is provided with a worm drive which is only rotatable by a hand crank or a motor, that can be self-turned by motor cut-off or hand-crank and not by attacking the winding shaft. A suitable formation of the top-most shutter element together with subsequent shutter elements (usually in a shutter box), prevents any unauthorized pushing up of the shutter armor. A previous weakness was the attachment of the top-most shutter element onto the exhaust-shaft, that previously resulted from screwing or bolting. After opening the shutter box, it was thus possible for an intruder with relatively simple tools to loosen the top-most shutter element from the winding shaft thereby pulling the shutter armor away despite the shaft being in the locked position.

The invention seeks to produce a roll-down shutter of a known type which provides greater security.

According to the invention, this is accomplished by binding the top-most shutter element to the winding shaft in a closed-shape.

With close-shaped binding, it is understood in the sense of the invention, that the binding has two structural pieces (here the winding shaft and the top-most shutter element) whereby the cohesion of the two parts is determined through the form of the two interlocking parts so that no additional binding agents such as screws, bolts or the like are necessary.

According to the invention, this closed-shape binding holds the two parts (winding shaft and top-most shutter element) undetachably together, but in contrast to the closed-shape where the parts are correspondingly bound together with essentially no slippage, restricted relative movement of the two parts is permitted. The top most shutter element may not be removed in a radial direction perpendicular to the axis of the winding shaft, but the binding is not completely fixed. It is possible to tilt or pivot the element and to remove it or insert it in an axial direction.

In a preferred embodiment, such a closed-shape binding between the winding shaft and top-most shutter element forms a first binding section in the axial direction on the winding shaft and a second binding section on the top-most shutter element in the axial direction of the shaft. The first binding section is joined to the second binding section to attach the shaft to the top-most shutter element—preferably with some looseness (play). With the assembly of the roll-down shutter, the two binding sections can simply be pushed into one another in axial direction and held together in closed-shape, whereby a removal of the top-most shutter element in any radial direction out of the winding shaft is not possible. Since a radial pushing out of the top-most shutter element is not possible with insertion into the winding shaft and releasable binding agents such as screws, bolts, or similar are not provided, the top-most shutter element cannot be separated from the winding shaft, thus making it impossible for the intruder to pull up the shutter.

Figure 3:
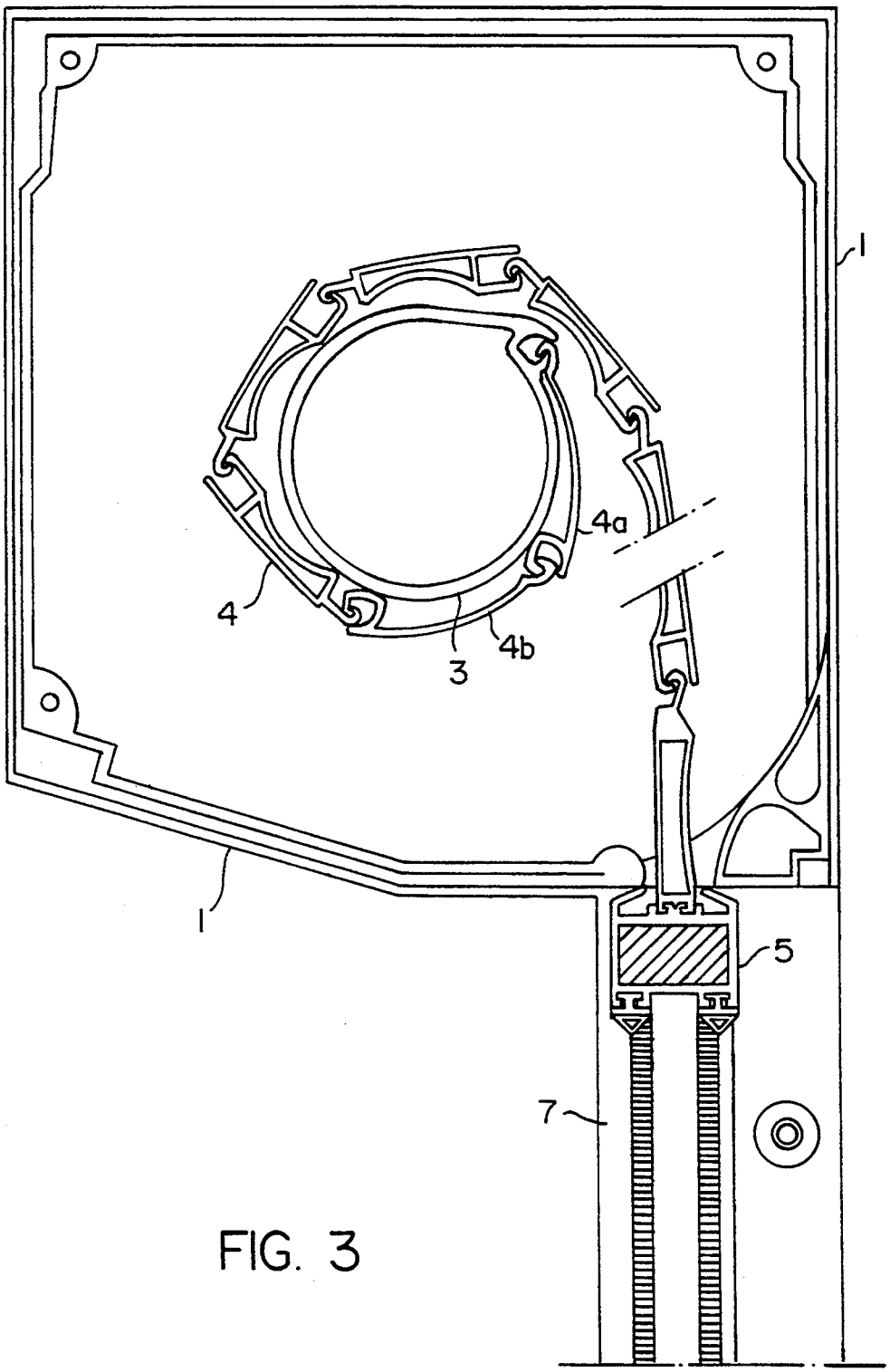

Further advantages and features of the invention will be described in more detail in the following description of the drawings:

FIG. 1 shows an embodiment of the unwound roll-down shutter in cross sectional view (locked position). FIG. 2 shows a cross section of a second embodiment with unwound roll-down shutter (locked position). FIG. 3 shows a cross section of the embodiment of FIG. 2 with a partially wand roll-down shutter (armor).

The roll-down shutter shown in FIG. 1 encompasses a winding shaft (3) positioned in a shutter box (1) rotatable around the axial beam (2) being self-locking, i.e. is not able to be turned from the outside by a stationary driving motor or operating crank. This is attainable through incorporation of a worm drive. FIG. 1 shows interlocking shutter elements (4*a*), (4) with shutter armor in the unwound condition. The shutter elements (4) beneath the shutter box (1) are driven along two guide rails (7) at the side. The shutter armor with steel inserts comprises a produced terminal structure (5) with added packing strips (6) on its underside being made of elastic material.

According to the invention, the top-most shutter element (4*a*) is bound in closed-shape with the winding shaft (3) without the means of fastening agents such as screws, bolts, or the like.

In addition, as primary binding section a slot (8) that extends towards the winding shaft in the axial direction is provided. The top-most shutter element comprises a second binding section (9) formed through a structured longitudinal-edge. The slot (8) has a widened region and a slot opening (8*a*). The binding section (9) of the top-most shutter element (4*a*) has a greater cross-sectional diameter in the widened region of the slot (8) than that of the external slot-opening (8*a*). Thus the top-most shutter element (4*a*), upon insertion to the winding shaft, cannot be extracted therefrom. The top-most shutter element (4*a*) can be easily inserted into the slot in the axial direction during assembly of the roll-down shutter. However—as was mentioned—with roll-down shutter construction, an axial expulsion of the top-most shutter element (4*a*) in all practical instances is not possible, and for special installations additional security (i.e. pins, pegs, or the like) against axial displacement of the top-most shutter element can be added.

The slot (8) and its terminal wall can be formed in one piece with the winding shaft in order to prepare a stable support for the top-most shutter element (4*a*). The winding shaft can be formed as a hollow extruding aluminum section which is comparatively easy to produce and can be cut to the desired length.

In order to facilitate a spatially acceptable unwinding of the shutter armor by the winding shaft on one hand and yield a locking function against undue pushing up of the armor on the other hand, the top-most shutter element (4*a*) is preferably positioned on the winding shaft with the ability to swivel. The top-most shutter element (4*a*) and the winding shaft (3) are so structured that the top-most shutter element originates from an existing point confined to the winding shaft (i.e. wound roll-down shutter in FIG. 3) and can only be swung away at a maximum angle $\alpha$ from the winding shaft. Accordingly the bottom most shutter element (5) is set below. The winding shaft can be turned further clockwise until the position represented in FIG. 1 is created, by which the top-most shutter element (4*a*) is turned as far away as possible from the winding shaft (3), and projects under the lock-angle $\alpha$ from the winding shaft (3). In this position the top-most shutter element (4*a*) can no longer be turned further from above. Since the winding shaft (3) is self-locking, it can also not be turned counter-clockwise, thus an unauthorized pushing-up of the shutter armor is not possible.

The top-most shutter element (4*a*) also performs a locking function. Because it always stays within the shutter box, it can be alternatively formed with unwound shutters as the visible preferably hollow structured shutter element. In particular, the top-most shutter element can be a laminated locking section extending over the whole length of the winding shaft, whose one sectioned longitudinal-edge is bound with the winding shaft and whose other sectioned longitudinal borders stand linked with the next shutter element (4) in the binding. One such preferably curved locking section in cross-section withstands high stress-effect and, as shown in FIG. 3, can compactly lie in coiled state on the peripheral area of the winding shaft (3). The locking section (4*a*) can be preferably made of Aluminum.

In addition to the locking function that is given throughout when the top-most shutter element (4*a*) (locking section) can only be turned in a limited dial sector across the winding shaft (3), a locking effect can be achieved throughout by adjoining the top-most shutter element (4*a*) and the winding shaft (3) away from the longitudinal edge (10) on the inside wall of the shutter box (1).

The schematic representations of FIGS. 2 and 3 differentiate themselves from FIG. 1 essentially through a larger shutter box (1) for the incorporation of larger shutter armor. In addition on the locking section (4*a*) (top-most shutter element) another similar locking section (4*b*) is positioned with the ability to swivel.

FIG. 2 shows the locked position which prevents an unauthorized pushing-up of the shutter armor. Thereby the feature of a second shutter element (locking section 4*b*) that can be rotated across the first up to a lock-angle of $\approx 180°$. The slot 8′ provided on the outside longitudinal-edge of the top-most shutter element (4*a*) can be formed essentially the same as the integrated slot (8) in the winding shaft (3). Also the pieces (4*a*) and (4*b*) are close-shaped, in the sense of the invention interlocked, and cannot be separated from one another upon insertion to the roll-down shutter.

FIG. 3 shows the winding process and in particular how the slim locking sections (4*a*) and (4*b*) lie flush on the peripheral area of the winding shaft (3).

The invention is not limited to the embodiments represented. For example the top-most shutter element (4*a*) may not extend over the entire length of the winding shaft (although this occurs advantageously for reasons of technical production and stability). It would be also conceivable that the top-most shutter element (4*a*) and the adjacent interlocked shutter element in each case consist of two or more axial adjacent shutter element-(parts), on which the proper shutter armor is placed. In the represented embodiments the winding shaft comprises a slot in which the top-most shutter element is held close-shaped. It would also be conceivable that the slot is formed on the top-most shutter element and comprises a projecting shoulder from the winding shaft in order to bind the shaft with the top-most shutter element making it safe from intrusion.

What is claimed is:

1. A roll down shutter comprising a rotating, self-locking winding shaft with coilable shutter armor made of linked interconnected shutter elements, the top-most shutter element being attached to the winding shaft, the top-most shutter element comprising a solid section, the remaining shutter elements being hollow-structured and having a thickness greater than the thickness of the top-most shutter element, the winding shaft having a first binding section formed by a slot having a widened region and an external opening, said slot lying in the axial direction of the shaft, and the top-most shutter element having a second binding section comprising a member sized to fit removably within the widened region of the slot, the member being encompassed by the slot and having a width greater than a width of the external opening of the slot, so that a removal of the top-most shutter element out of the winding shaft in each direction perpendicular to the axis of the winding shaft is not possible.

2. Roll down shutter according to claim 1, characterized in that the external opening in said slot is located on the winding shaft's peripheral area, and that the second binding section of the top-most shutter element is preferably inserted in the slot in the axial direction producing a greater cross sectional diameter in the widened region of the slot than in the external opening.

3. Roll-shutter according to claim 1, characterized in that the top-most shutter element comprises a laminated locking section stretched over the entire length of the winding shaft, whose one sectioned longitudinal-edge is bound with the winding shaft and whose other sectioned longitudinal-borders stand linked with the next shutter element in the binding.

4. A roll down shutter comprising a rotating, self-locking winding shaft with coilable shutter armor made of linked interconnected shutter elements, the top-most shutter element being attached to the winding shaft, the top-most and the second shutter elements comprising solid sections, the remaining shutter elements being hollow-structured and having a thickness greater than the thickness of the top-most shutter element, the winding shaft having a first binding section formed by a slot having a widened region and an external opening, said slot lying in the axial direction of the shaft, and the top-most shutter element having a second binding section comprising a member sized to fit removably within the widened region of the slot, the member being encompassed by the slot and having a width greater than a width of the external opening of the slot, so that a removal of the top-most shutter element out of the winding shaft in each direction perpendicular to the axis of the winding shaft is not possible, wherein said top-most shutter element is bound with the ability to swivel with said second shutter element, whereby said second shutter element can be swung from said top-most shutter element only up to a determined lock-angle of preferably $\approx 180°$.

5. Roll down shutter according to claim 4, characterized in that the second shutter element projects under the lock-angle of the top-most shutter element.

* * * * *